US007309302B1

(12) United States Patent
Phillips

(10) Patent No.: US 7,309,302 B1
(45) Date of Patent: Dec. 18, 2007

(54) SLIDING EXERCISE APPARATUS AND RECREATIONAL DEVICE

(76) Inventor: Forrest B. Phillips, P.O. Box 3682, Napa, CA (US) 94558

( * ) Notice: Subject to any disclaimer, the term of this patent is extended or adjusted under 35 U.S.C. 154(b) by 430 days.

(21) Appl. No.: 09/819,256

(22) Filed: Mar. 27, 2001

Related U.S. Application Data

(63) Continuation-in-part of application No. 09/344,302, filed on Jun. 24, 1999, now Pat. No. 6,231,483.

(51) Int. Cl.
*A63B 9/00* (2006.01)
*A63G 21/00* (2006.01)

(52) U.S. Cl. ..... 482/35; 472/116

(58) Field of Classification Search ..... 482/31–36, 482/51; 182/48; 472/116–117, 128
See application file for complete search history.

(56) References Cited

U.S. PATENT DOCUMENTS 2,982,547 A * 5/1961 Carrier ..... 472/117
3,712,417 A * 1/1973 Chacko et al. ..... 182/48
3,811,534 A * 5/1974 Fisher ..... 182/48
4,148,477 A * 4/1979 Larson ..... 472/91
4,762,316 A * 8/1988 Merino ..... 472/88
4,805,898 A * 2/1989 Jacober et al. ..... 472/117
4,887,811 A * 12/1989 Tresh ..... 473/451
5,135,440 A * 8/1992 Smollar et al. ..... 472/128
5,246,401 A * 9/1993 Boatwright ..... 472/116
5,326,338 A * 7/1994 Makous ..... 482/51
5,387,158 A * 2/1995 Bertrand ..... 472/117
5,401,214 A * 3/1995 Smollar et al. ..... 472/117
5,407,393 A * 4/1995 Schmidt ..... 472/117
5,478,281 A * 12/1995 Forton ..... 472/117
5,669,822 A * 9/1997 Smollar et al. ..... 472/117
5,676,602 A * 10/1997 Katz et al. ..... 472/117
5,875,868 A * 3/1999 Smialowicz et al. ..... 182/48
6,062,983 A * 5/2000 Butsook ..... 472/117
6,142,879 A 11/2000 Phillips
6,223,673 B1 * 5/2001 Mears et al. ..... 114/264
6,231,483 B1 5/2001 Phillips
6,406,377 B1 * 6/2002 Demko ..... 472/117
D460,141 S * 7/2002 Gourchounian ..... D21/820
6,648,767 B1 * 11/2003 Chen ..... 472/117
6,984,195 B1 1/2006 Phillips

OTHER PUBLICATIONS

Video still shots inflatable slide made by Inflatable 2000 at "X Games" in San Francisco, CA on Aug. 20, 2000 (Video taken by inventor, Forrest Phillips) 2 pgs.
Video still shots of a poster of inflatable slides made by Magic Jump at "Fun Expo 2000" a trade show in Las Vegas, NV on Sep. 23, 2000 (Video taken by inventor, Forrest Phillips) 3 pgs.

(Continued)

*Primary Examiner*—Fenn C. Mathew
(74) *Attorney, Agent, or Firm*—Wolf Greenfield & Sacks

(57) ABSTRACT

A sliding exercise apparatus and recreational device which can be employed both wet and dry. A user can traverse the device which includes a surface which can be inclined as a durable low friction sheeting material. The user can be supported by a wide variety of vehicles including sports boards and clothing apparel which, in turn, have a durable low friction layer for contacting the sliding exercise apparatus and recreational device for entertainment and in order to enhance gymnastic and board skills.

38 Claims, 16 Drawing Sheets

OTHER PUBLICATIONS

Video still shots of a poster of an inflatable slide made by Ninja Jump at "Fun Expo 2000" a tradeshow in Las Vegas, NV on Sep. 23, 2000 (Video taken by inventor, Forrest Phillips) 2 pgs.

Magic Jump brochure of inflatable slide item No. 11410S and 13410S from "Fun Expo 2000" a tradeshow in Las Vegas, NV on Sep. 23, 2000, 2 pgs.

Inflatable 2000 brochure of inflatable slides with product price list from meeting between inventor, Forrest Phillips and Inflatable 2000 which occurred on Sep. 11, 2000, 5 pgs.

DVD video taken by inventor, Forrest Phillips, tracking invention process from 1999-2001, approximately 14 minutes 59 seconds.

www.inflatable2000.com/interactives/waterslide.html, printed Aug. 27, 2002, 2 pgs.

* cited by examiner

SLIDING EXERCISE APPARATUS AND RECREATIONAL DEVICE

RELATED APPLICATIONS

The present application is a continuation-in-part of U.S. application Ser. No. 09/344,302 filed Jun. 24, 1999, now U.S. Pat. No. 6,231,463.

TECHNICAL FIELD AND INVENTION

The present invention is directed to an exercise apparatus and recreational system composed of a plurality of interconnecting parts which include a slide having a low friction, durable top layer upon which a user can traverse in both a wet or dry condition. The sliding aspects of this invention may be applied to a number of conventional board sports or may be adopted to novel uses including equipping apparel or shoes with low friction material to allow the user to slide without additional encumbrances. The invention can also be considered a recreational device whereby a user can slide upon a surface which can be inclined while being supported by a low friction, durable membrane either attached to a sports board or as stand-alone sheeting material. The sliding surface of the invention may be configured to simulate a variety of terrains. Such slides can be inflatably employed with or without structural frames, be portable or fixed and employed with bouncy surfaces and include trampolines and ramps to make complex recreational centers.

BACKGROUND OF THE INVENTION

Although there are a plethora of sliding devices which are employed for recreational purposes, the art is devoid of such devices which are provided with practical universal applicability to satisfy a number of diverse and seemingly unrelated characteristics. For example, it is oftentimes a design goal to provide a slide which is portable. Other times, slides which are bouncy are sought after. As will be more fully developed below, it is suggested that both design goals can be met by providing slides which are inflatable. Other users seek recreational complexes in which slides are employed with activity sections such as trampolines and ramps which are detachable from one another and thus can be configured into a variety of shapes and orientations to enhance a user's recreational experience. None of these design goals have been achievable in the past particularly when dealing with such devices which can be employed both wet and dry.

In addition to recreational use of sliding exercise apparatus and recreational devices, as will be more fully embellished below, the present invention deals with the enhancement of sports board skills and thus can be used as a training tool by the serious sports enthusiast. For example, virtually all sports board enthusiasts face the problem of how to maximize recreational practice, skill development and exercise during times of the year when use of such equipment is not feasible. For example, snow boarders find that after a full winter season, their skills are enhanced but after the spring, summer and fall months of inactivity, board skills must be redeveloped and tuned once winter conditions provide the appropriate backdrop for practicing the sport.

Not only do winter sports enthusiasts face the grim prospect of having to go long periods between board usage, others, such as surfers, face similar constraints. Obviously, the surfer can only effectively use a surfboard when ocean access is available. There are times when surfers must travel inland and away from major bodies of water preventing board usage. As such, the invention can be used with a wide and diverse list of sliding vehicles which currently exist or are configured specifically for use herein including roller skates, rollerblades, skateboards, skis, waterskis, sleds, air mats, rubber/foam mats, body boards, skimboards, knee boards, wake boards, ice skates, surfboards, snowboards, mountain boards, sand boards, sail boards, snow luge, street luge, knee pads, elbow pads, wrist guards, clothes, suits, shoes, socks, plush vehicles, plush animals, plush objects, scooters, bikes, tricycles, snowmobiles, spheres, discs, sheets, bags and cases.

In addition to the above-noted uses, it has been recognized that certain advantages are inherent in providing a sliding surface which is either inflatable or padded. A sports enthusiast or recreational user can employ such a sliding surface to practice extreme skills knowing that the forgiving nature of the slide will substantially reduce the risk of injury. Even wheel-bearing sporting goods such as in-line skates and skate boards can be used in conjunction with the present exercise apparatus and recreational system providing a safer platform for such activity than would otherwise be available.

It is thus an object of the present invention to provide a sliding exercise apparatus and recreational system which can be both stationary and portable, have a number of subsidiary activity sections such as trampolines as well as ramps which can be employed in both a wet and dry state.

It is further an object of the present invention to provide a sliding exercise apparatus and recreational system which is covered, on its top surface, with a low friction, durable sheeting material and which can be used both recreationally and further to enhance board skills in both a wet and dry condition.

It is still a further object of the present invention to provide a sliding exercise apparatus which can be employed with or without structural frame members and which can either be configured as a permanently fixed installation or be made portable for on-site assembly.

These and further objects will be more readily apparent when considering the following disclosure and appended claims.

SUMMARY OF THE INVENTION

The present invention is directed to a low friction, durable sheeting material which can be used in both a wet and dry condition as well as a sliding exercise apparatus and recreational system which includes a slide for supporting a user, such slide having a top surface, at least a portion of which can be inclined to facilitate gravity-induced sliding. The top surface is provided with said low friction, durable sheeting material which enables the user to traverse thereon whether the top surface is wet or dry. The slide can be inflatable or padded and can be optionally fixed to a rigid frame or made free standing without a frame. It can be made to reside in a fixed location or made to be portable. The slide can be designed to reside on land or on water and can be employed with a variety of ancillary expedients such as pumps and related tubing to circulate water over the top surface of the slide to provide a wet surface as well as a refrigerator unit to create snow or ice to more closely replicate wintry conditions.

The present invention further is directed to a sliding activity center comprising in combination, a slide as recited above and a plurality of appended activity sections. It is contemplated that these activity sections can be removably and interchangeably appended to the slide to both add to the recreational experience in employing the present invention and provide skill enhancing stations for those so inclined. Activity sections can include additional slides with surfaces of varying frictional characteristics and profiles as well as trampolines, water pools, zip lines, tubes, ramps, barrels and chutes to name just a few. The activity sections are positioned such that a user can transition between the slide and the appended activity without constraint enabling a user to take full advantage of the recreational and skill development opportunities which are available in practicing this invention.

As one embodiment, the present invention contemplates the use of a sports board, being of sufficient size and rigidity to support a user on the present exercise and recreational center. The sports board is provided with a top for contacting the user and a bottom for sliding upon a slide. As in the previous embodiments, the slide is provided with a top surface which can, in one embodiment, be inclined to facilitate gravity-induced sliding thereon. The top surface is further characterized as having a low friction, durable sheeting layer which enables a user to traverse thereon whether the top surface is wet or dry and an additional low friction, durable sheeting layer appended to and supported by the bottom of the sports board such that each low friction, durable sheeting layer is designed to engagingly contact one another as a user is supported by the sports board for sliding on the top surface. Alternatively, the sports board can support wheels, thus obviating the need for the sheeting layer thereon. In addition, the present invention contemplates, instead of the use of a sports board, the use of a highly durable low friction membrane which acts as a sheeting layer for supporting a user as the user traverses the top surface of the slide. The membrane itself can be composed of a low friction, durable sheeting material which enables the user to traverse the slide in both a wet and dry condition. This membrane, in addition to being used as a stand-alone flexible sheet, can also be employed in small sections which are appended to the clothing of a user such as the bottom of one's feet and the outer surface of typically employed knee pads.

DETAILED DESCRIPTION OF THE INVENTION

Figure 1:
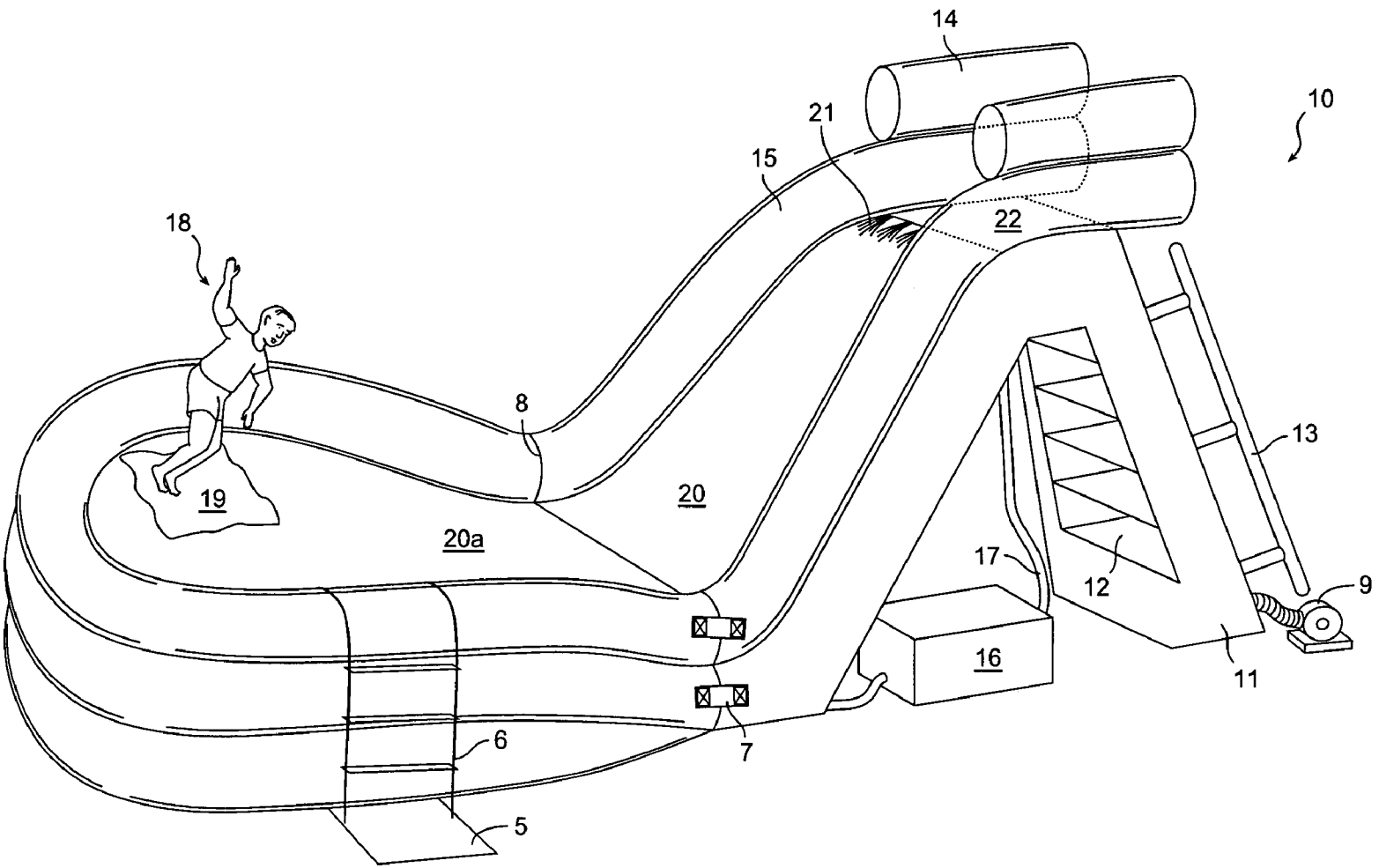
FIG. 1 is a perspective view of one embodiment of a slide configured pursuant to the present invention.

FIG. 1 depicts slide 10 used as the focal point of the exercise apparatus and recreational system of the present invention. As shown, optional framework 11 supports stairs 12 and railing 13 to enable a user to enjoy slide 10 as a recreational device. Slide 10 is provided with top surface 20 which, need not be, but in this illustration is inclined to facilitate gravity-induced sliding thereon. Top surface 20 is composed of a flexible sheeting layer of a durable, low friction material enabling the user to traverse the slide whether the top surface 20 is wet or dry.

As further noted by reference to FIG. 1, slide 10 is provided with bumpers 14 and 15 to define top surface 20 and to prevent the inadvertent slippage from top surface 20. FIG. 1 shows water pump 16 and hosing 17 to enable slide 10 to be used dry (as shown) or wet by introducing water through piping 21. Alternatively, element 16 could be a refrigerator unit which could supply snow or ice to the slide surface through hosing 17 in order to replicate wintry conditions. Slide 10 is shown as having a top or beginning portion 22 in the form of a substantially flat pad. The pad can be of higher friction material to prevent inadvertent slippage and can be, for example, a bouncy surface such as a trampoline to enable a user to create a bouncing motion prior to launch upon top surface 20.

FIG. 1 further illustrates an infant as user 18 clearly employing slide 10 as a recreational device. In this instance, user 18 is supported by membrane 19 in the form of low friction durable sheeting material as more clearly depicted in FIG. 6 and discussed hereinafter with regard to that figure. Both membrane 19 and top surface 20 can each be composed of low friction high durable materials such as a member selected from the group consisting of nylon, Teflon, sailcloth, Dacron, vinyl, artificial turf, synthetic carpet and polyester resins. This enables user 18 to traverse top surface 20 in a dry state without need for an optionally induced wet surface through the injection of water through jets 21.

Slide 10 of FIG. 1 can be constructed permanently in a single location or be made portable. Portability is enhanced by producing slide 10, at least as to its bumpers 14 and 15 and support area below top surface 20 as inflatable membranes which can be collapsed when deflated for storage and portability. Inflation can be maintained through the use of one or more blowers 9. In addition, inflatable membranes add to the bouncing characteristic which many users find appealing. For example, as noted previously, top or launch pad 22 can be in the form of a trampoline which enables a user to commence use of slide 10 by bouncing first on pad 22 whereupon user 18 progresses along top surface 20. Alternatively, the slide can be made of padded elements which, although not enhancing portability, can create a safe recreational system. Further, the slide can be made in sections shown joined along seam 8 and held together by fasteners 7. Area 20*a* can be a continuation of surface 20 or can be filled with water or plastic or Styrofoam balls (not shown). When filled with water, a simulated wave machine can be employed to create wave action for user 18. To facilitate exiting from area 20*a*, ladder 6 can be draped over the bumper to step on area 5.

Figure 2:
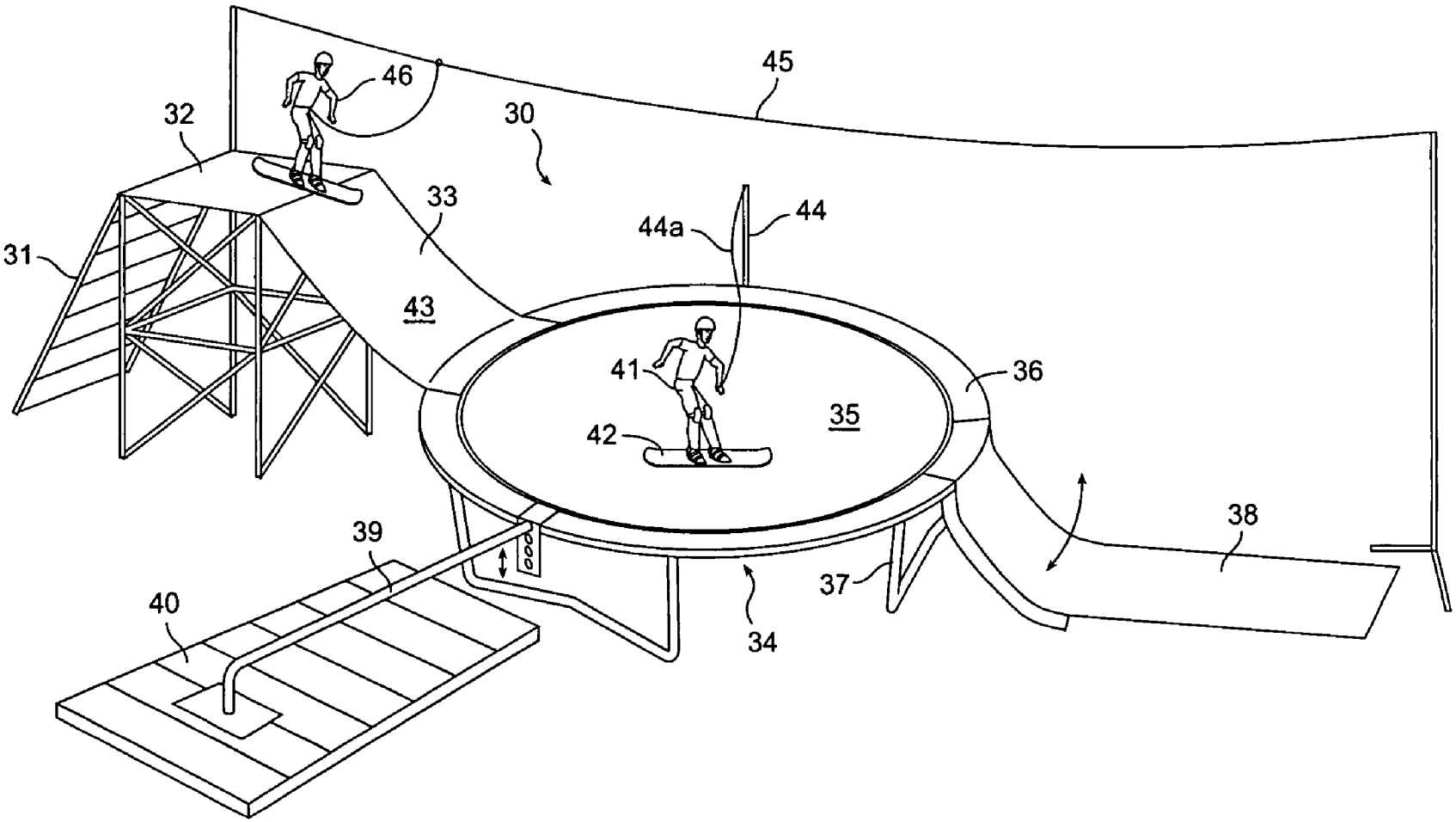
FIGS. 2, 3 and 4 are perspective views of the combination of a slide, trampoline, ramp and other additional elements constituting further embodiments of the present invention.

FIG. 2 depicts yet another example of the present invention. In this instance, the invention is depicted as a sliding activity center 30 including a number of elements which are selectively combined to produce such an activity center which can function not only as a recreational device but also as a skill enhancement sports tool. Sliding activity center 30, in the embodiment shown in FIG. 2, includes stairway 31 to enable a user to climb to an elevation as defined by launch pad 32. Slide 33, as in the embodiment shown in FIG. 1, is provided with a top surface 43 of a durable low friction layer which can either be permanently bonded to slide 33 or consist of a sheeting material that lays across a padded or inflated membrane as desired.

As noted previously, activity center 30 is composed of a number of elements some of which are depicted in FIG. 2 while others are shown in later drawings and each of which can optionally be detachable from one another so that their component parts can be rearranged as well for storage and portability. As such, sliding activity center 30 is merely illustrative of one of an almost limitless number of combinations constituting the present invention. In this instance, top surface 43 of slide 33 leads directly into activity section 34 which, in this instance, comprises a trampoline having a bouncy trampoline surface 35 held in place by framework 36 and 37. As shown, user 41 on sports board 42 is depicted bouncing upon trampoline surface 35 having progressed along top surface 43. As in the previous embodiment, all of the component parts of the present invention including the top surface of trampoline 35 as well as the bottom surface of sports board 42 can be optionally provided with durable low friction sheeting material so that the present invention can be employed in a dry condition. Other add-on features can also be appended to enhance the recreational and skill building aspects of the present invention. For example, pontoon pole 44 and bungee line 44*a* can be used as well as zip line 45 elevated above surface 35 to support user 46.

Once user 41 decides to exit trampoline bouncy surface 35, several routes can be taken. For example, user 41 can progress along ramp 38 which again can be covered with a low friction durable sheeting material. As an alternative, user 41, if appropriately skilled, can exit bouncy surface 35 and onto adjustable sliding rail 39 which itself can be optionally covered with a low friction durable material. Both rail 39 and ramp 38 can be made adjustable as they connect to trampoline frame 36 so that their angles of inclination with respect to surface 35 can be altered as the skill level of the user so dictates. Again, each of the component parts including trampoline 34, ramp 38 and rail 39 can optionally detach from one another and the various component parts rearranged. For example, one could configure the sliding activity center of FIG. 2 such that a user would, upon exiting slide 33, proceed to adjustable sliding rail 39 and, upon leaving adjustable sliding rail 39, enter trampoline 34 whereupon the activity center is exited by proceeding along ramp 38.

Figure 14A:
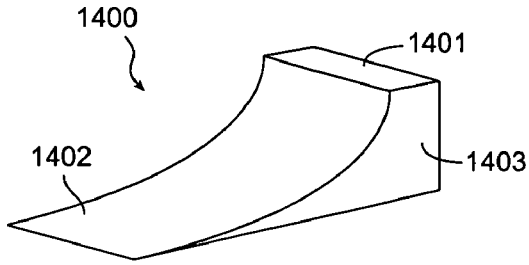
FIGS. 14A-14E are a series of perspective views of various ramp and ramp-like structures for use herein.
Figure 14B:
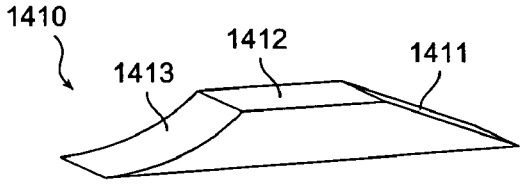
Figure 14C:
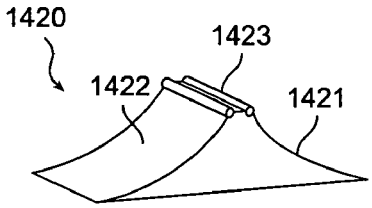
Figure 14E:
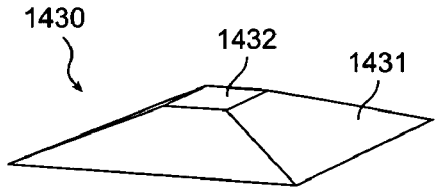
Figure 14D:
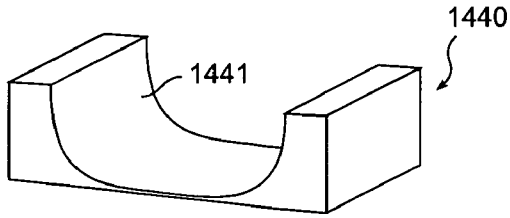

It is further noted that ramp 38 of FIG. 2 can assume a number of alternative embodiments. In this regard, reference is made to FIGS. 14A-E. In FIG. 14A, take-off ramp 1400 can be installed within activity center 30 in place of ramp 38. Horizontal ramp surface 1401 and sloping ramp surface 1402 supported by base 1403 can be coated with durable low friction sheeting material to enable wet or dry use. Turning to FIG. 14B, fly box 1410 which is made up of nested elements in the form of ramps 1411 and 1413 which each abut central (horizontal) box portion 1412. As a further alternative, reference is made to FIG. 14C showing ramp 1420 having inclined surfaces 1421 and 1422 which, at their joint apex, is provided spine 1423 enabling skate boarders and similar enthusiasts to confront an edge to hone their skills. Similarly, reference is made to FIG. 14D showing pyramid structure 1430 having four sloping side walls 1431 and top flat pad 1432. Again, this surface can be coated with a low friction durable coating material and used as a ramp as previously discussed. Finally, reference is made to FIG. 14E showing a half pipe 1440 having curved pipe surface 1441 used by skating and sports board enthusiasts.

Figure 3:
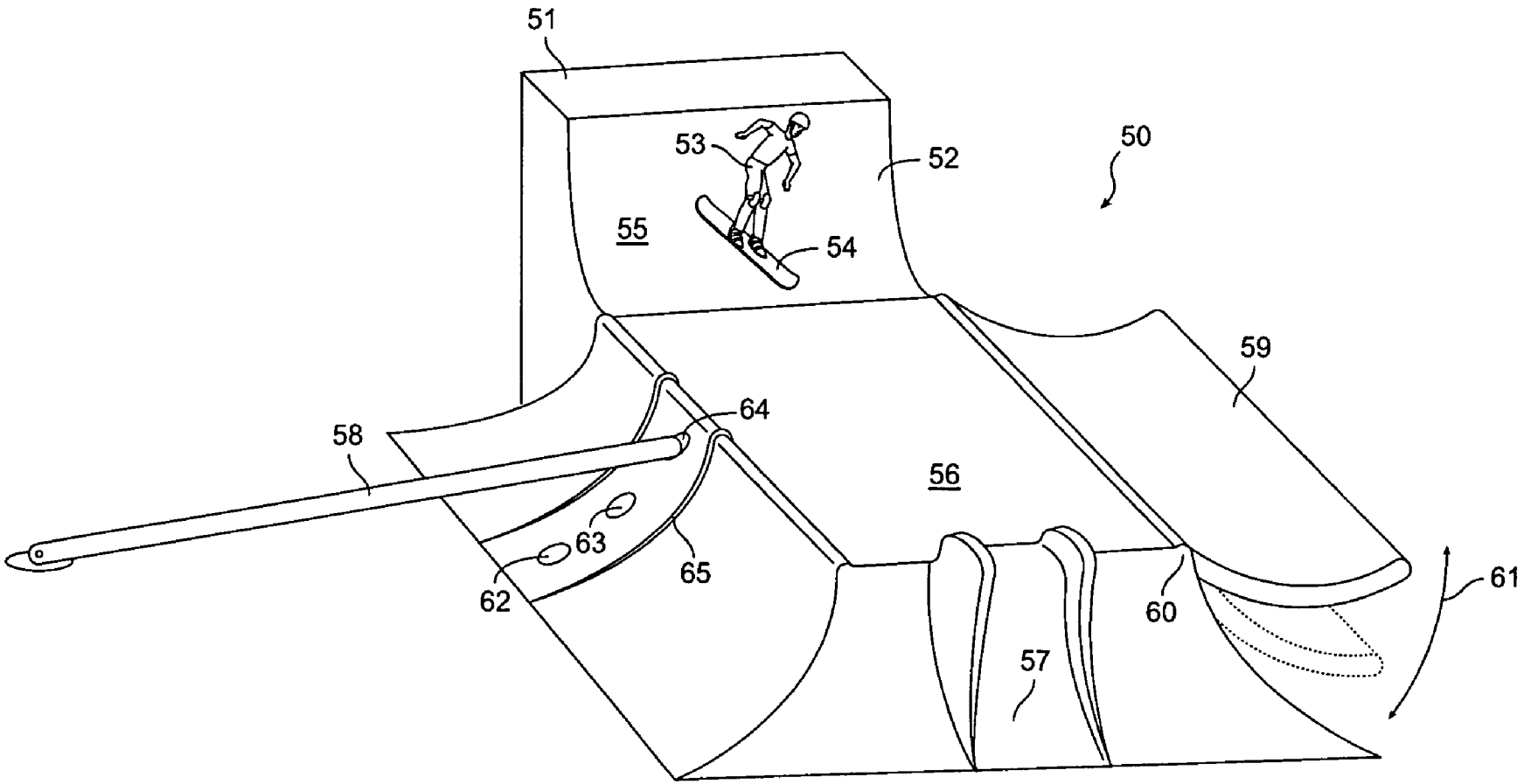

FIG. 3 is an illustration of a sliding exercise apparatus and recreational system further embodying various elements constituting the present invention. Sliding exercise apparatus and recreational system 50 is shown with various interrelated component parts. Specifically, slide 52 is shown as having an incline to induce rider 53 on sports board 54 to travel along top surface 55; the top surface, as in the previous embodiments, being optionally composed of durable low friction sheeting material. This particular embodiment shows horizontally oriented launch pad surface 51 which can be comprised of a relatively high friction material to enable a user to achieve a sense of stability. At the bottom of slide 52 is shown trampoline 56 enabling rider 53, upon exiting slide 52, to practice jumping on the bouncy trampoline surface atop sports board 54. User 53 would then have a number of options including exiting from the trampoline along chute 57, adjustable rail 58 or adjustable ramp 59. In each instance, these surfaces can be optionally covered with highly durable low friction sheeting material.

Again, turning to FIG. 3, it is noted that ramp 59 can be pivoted along axis 60 so that the inclination of ramp 59 can be varied as ramp 59 proceeds upwardly or downwardly in direction shown by arrow 61. Similarly, rail 58 can be received by any one of openings 62, 63 or 64 within frame 65 in order to vary the angle of inclination of rail 58 with respect to trampoline 56. Further, as previously noted, each of the component parts leading to trampoline 56 can be selectively removable from the trampoline so that the order in which the components are confronted by a user can be varied. Along these lines, reference is made to FIG. 4.

Figure 4:
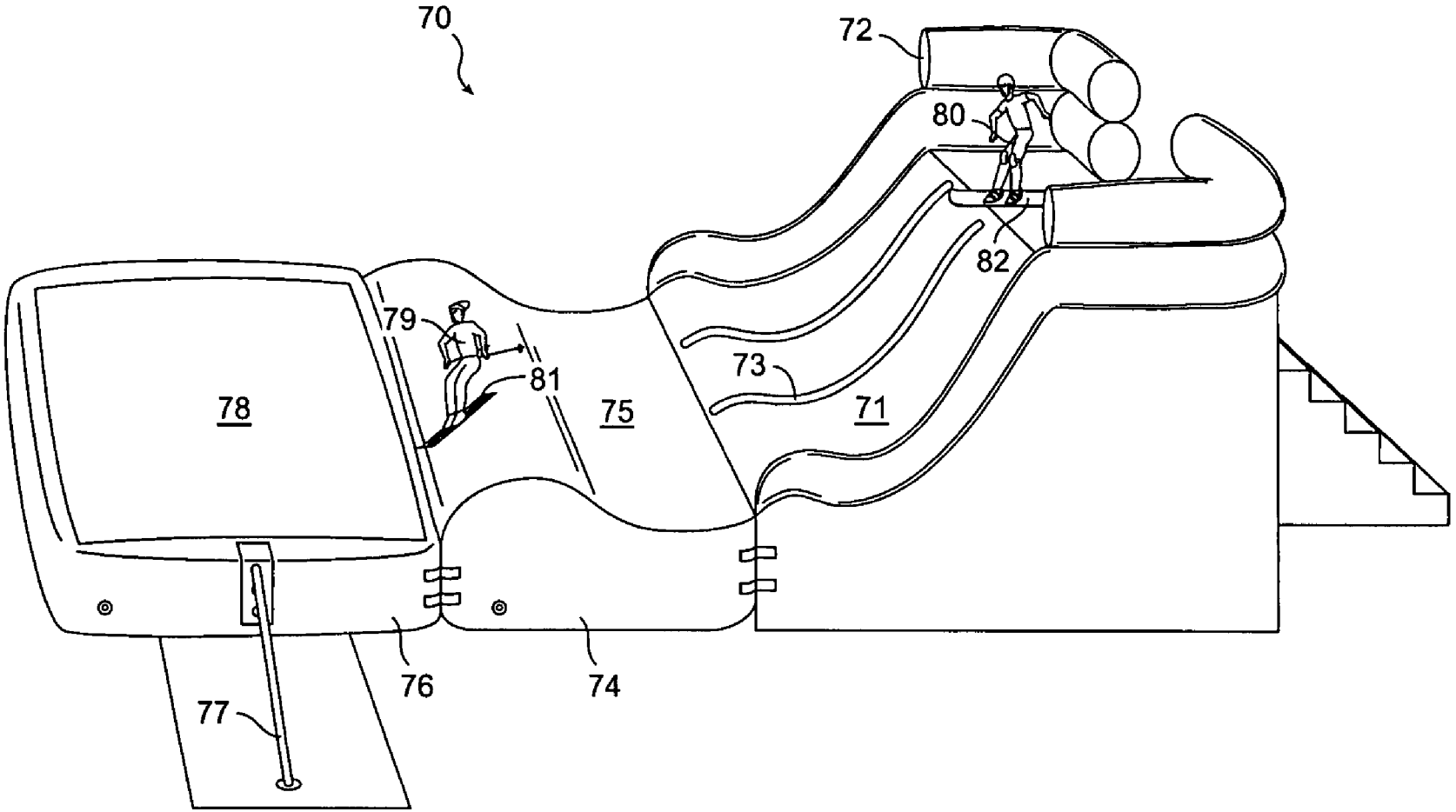

FIG. 4 discloses sliding exercise apparatus and recreational device 70 including slide 71 having bumpers or rails 73 in order to establish lanes upon top surface 83. In this embodiment, bumpers 72 are included within slide 71 which is optionally made up of air inflatable membranes much like that shown in FIG. 1.

The embodiment of FIG. 4 shows slide 71 transitioning to ramp 74 having uneven surface 75 to create somewhat of a mogul-like effect. This embodiment can be used to practice a number of board sports as well as be employed for recreational purposes. As such, rider 79 is shown on a snow board 82 at the top of slide 71 while user 79 is shown atop skis 81. As noted, rider 79 upon exiting ramp 74 transitions onto trampoline 76. The rider could then simply depart the trampoline by swinging his or her skis 81 over its edge or by progressing down adjustable rail 77 in a manner previously discussed. In each instance, the bottom surfaces of snowboard 82 and skis 81 as well as top surface 83 of slide 71, surface 75 of ramp 74 and surface 78 of trampoline 76 can be covered with low friction high durability sheeting material of the type previously recited. As noted previously, the sliding exercise apparatus and recreational system of FIG. 4 can be employed in both a wet and dry state while practicing the present invention. Further, the sliding exercise apparatus and recreational system of FIG. 4 could be selectively coated with ice or snow to more closely replicate real life conditions when climactic conditions make this feasible. As an example, area 78 could be in the form of a frozen layer of ice or a tub filled with plastic balls. However, to reiterate, the present invention is usable in a dry condition and without snow or ice being applied to any of the above-recited top surfaces.

Figure 5:
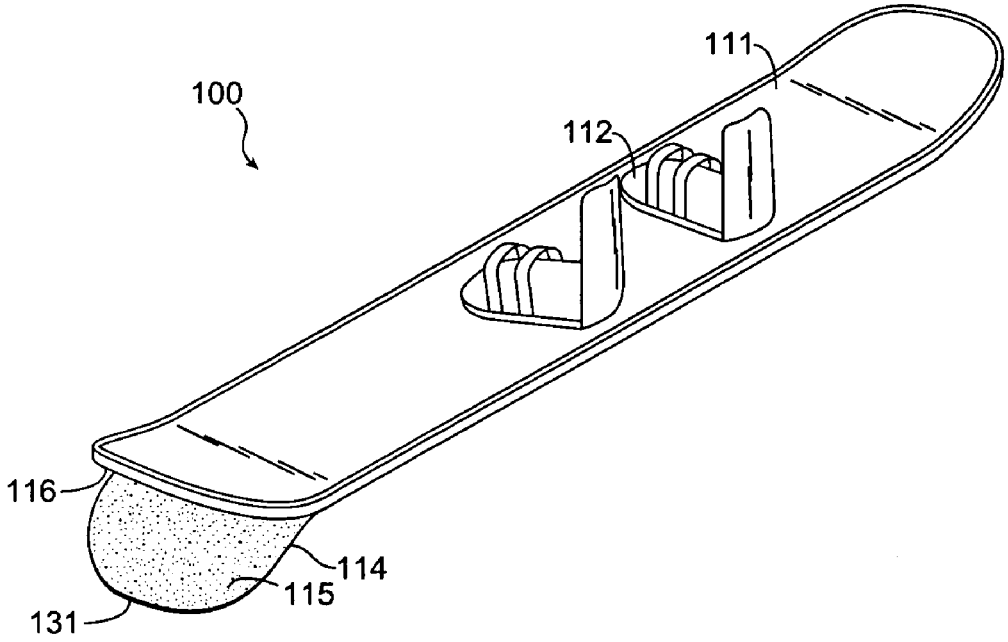
FIG. 5 is a perspective view of a sports board useful in practicing the present invention.

FIG. 5 depicts a sports board such as that shown as board 82 of FIG. 4. In this instance, board 100 having bindings 112 is of the shape of a snowboard having a rigid top surface 111, bindings 112 and bottom surface 116. As noted previously, durable low friction sheeting material 114 can be applied to bottom surface 116 by applying adhesive 115 to sheeting material 114 and adhering it to board 111. As an alternative to a sports board, a rider such as user 18 of FIG. 1 can employ a flexible membrane shown as element 90 of FIG. 6. Membrane 90 can take on a number of geometrical shapes as well as thicknesses and physical characteristics so long as bottom surface 91 is composed of low friction durable sheeting material. In other words, membrane 90 can be a single sheet of such material in the form of a rectangle or any other geometric shape upon which a user would sit or lie upon when employing the present invention or, alternatively, a durable low friction membrane 121 could be adhered to a three-dimensional sliding element 120 as depicted in FIG. 7. In this instance, low friction durable sheeting material 121 is adhered to a body section 122 which can be inflated or provided with stuffing material to take on a three-dimensional configuration thus providing additional cushioning to a user. Because the present invention can be employed in a dry condition, the body of sliding element 120 need not necessarily be water repellent while being functional in practicing the present invention.

Figure 6:
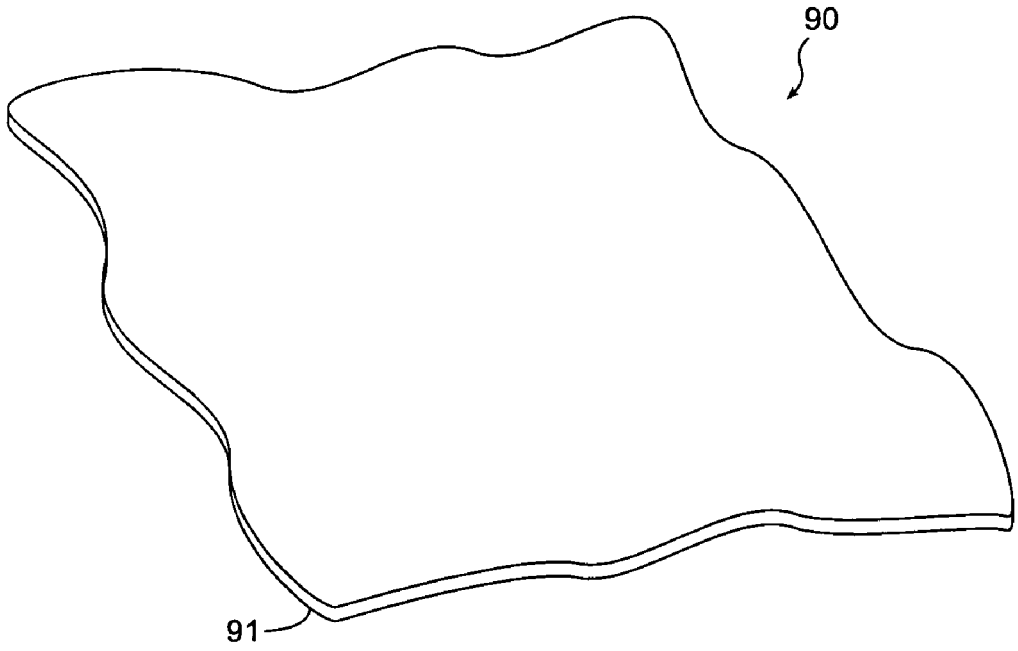
FIG. 6 is a perspective view of a membrane useful in supporting a rider when employing the present invention.
Figure 7:
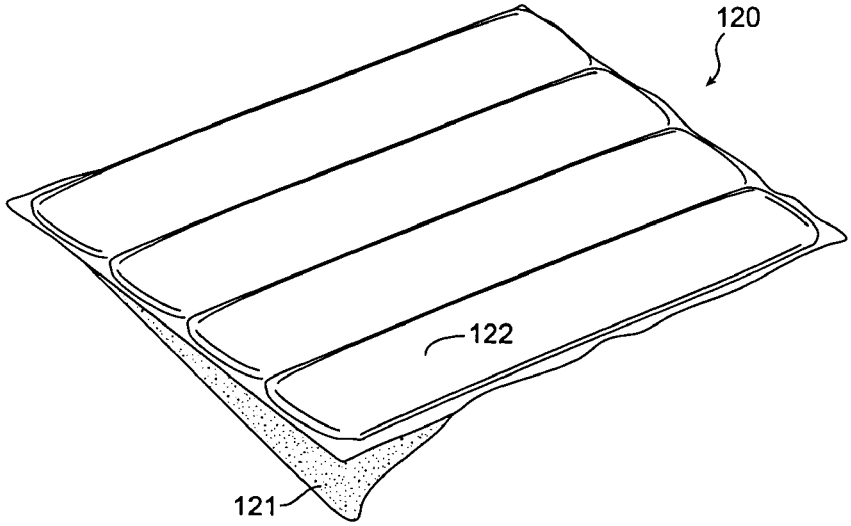
FIG. 7 is a perspective view of a modification of the membrane shown in FIG. 6.
Figure 8:
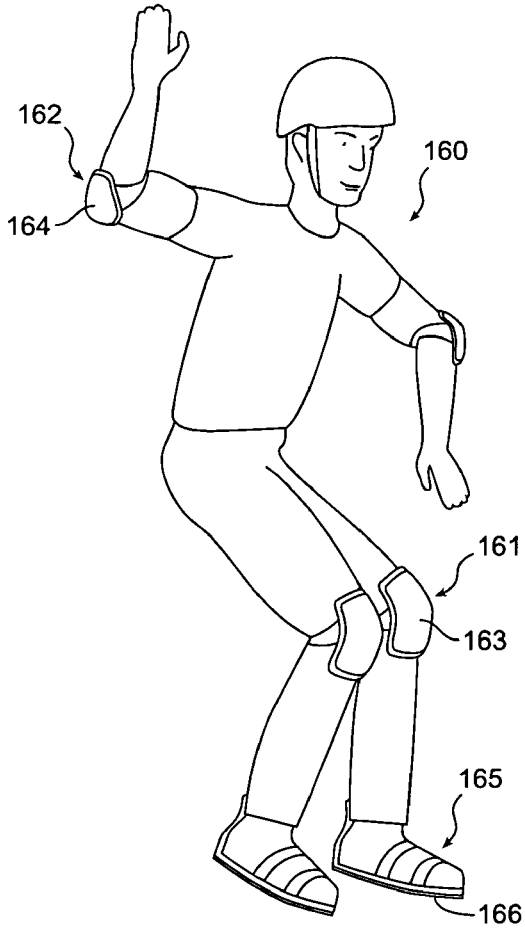
FIG. 8 is a perspective view of a user of the present invention employing yet a further embodiment thereof.

As a further embodiment, reference is made to FIG. 8 where, instead of employing durable low friction sheeting material as shown in FIGS. 6 and 7 upon which a user would reside, it depicts similar material shown as being selectively adhered to clothing or protective gear of a user so that one could employ the present invention without the need for a separate sports board or slidable membrane material whatsoever. Specifically, user 160 is provided with shin pads 161 and elbow pads 162, each of which can be provided with patches of durable low friction membrane material 163 and 164. Further, sandals or shoes 165 can be provided with similar low friction high durability membrane material 166 on the bottoms or sole portions thereof. One could even employ socks composed entirely of said low friction durable material for use herein. As such, user 160 could progress along the various slides, ramps, rails and trampolines of the present invention on one's knees, elbows or even in a standing orientation; thus one is able to enhance one's balance as well as engage in an enjoyable recreational pursuit.

Figure 9:
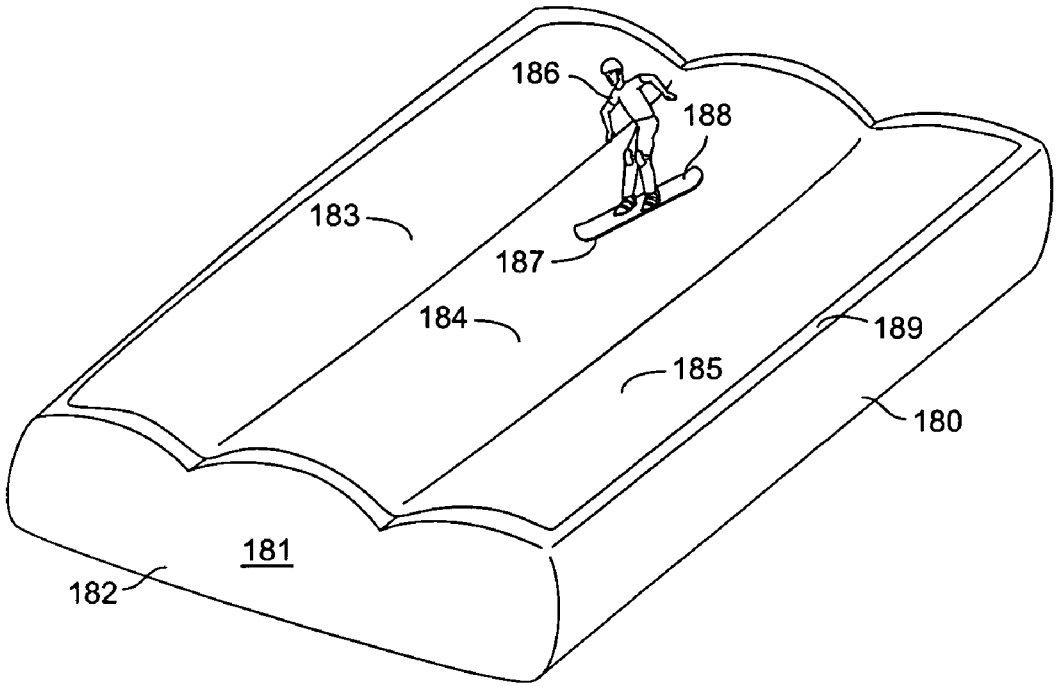
FIG. 9 is a perspective view of a portion of a slide for use herein, shown in partial cross-section.

Next, reference is made to FIG. 9 showing a portion of an inflatable slide 180. In this embodiment, membrane 182 encloses internal volume 181 which is ideally under sufficient pressure to support the structure of slide 180. In this instance, low friction durable sheeting material 183 is placed on the top surface of slide 180 and over seams 184 and 185. Along the top surface of slide 180, seams 184 and 185 create indents which can further enhance employment of the present invention. Specifically, rider 186 can employ board 187 which, in turn, supports in-line wheels 188. This board can traverse slide 180 along seams 184 or 185 as a means of engaging in both a recreational pursuit and skill enhancement in the use of an in-line skate or skate board.

Figure 10:
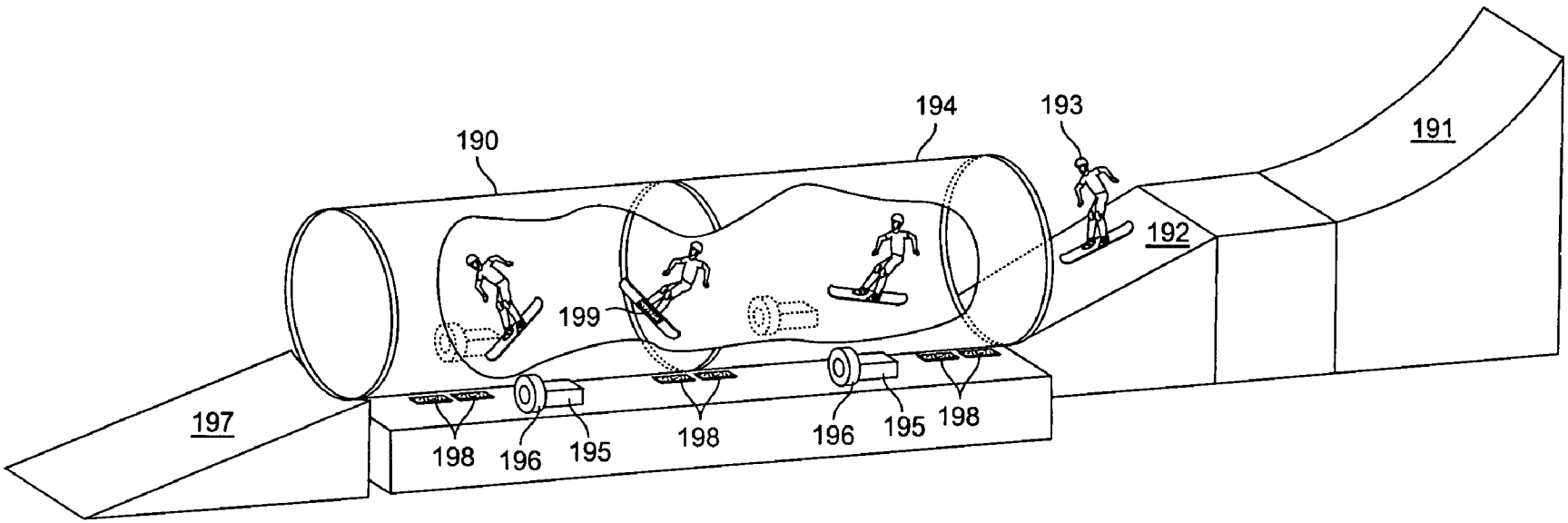
FIG. 10 is a perspective view of yet another embodiment of the present invention.

Turning to FIG. 10, yet another embodiment of the present invention is disclosed in an attempt to demonstrate the breadth of the present invention. Ramp 191 can act as the launching point for slide 190 or can be the continuation of a previous or upstream recreational device. User 193 on sports board 192 can traverse ramp 191 which, itself, can optionally be selectively covered with a durable low-friction material so that the invention can be used in a dry state. Rider 193 can then progress within metal or plastic cylinder 194 which can, as a preferred embodiment, be rotated either clockwise or counterclockwise through the use of motor 195 driving motorized wheels 196. As with ramp 191, the interior of cylindrical member 194, can be selectively coated with a durable, low-friction surface enabling user 193 to employ the present invention in a dry state. As a further embodiment permanent magnets 198 could be installed below cylindrical member 194 with other magnets 199 embedded in a users vehicle of the same facing or repelling polarity. This would reduce any friction between the user's vehicle and cylindrical member. User 193 can remain within cylindrical member 194 sliding along its inner surface as motor 195 turns cylinder 194 as desired. At any time, rider 193 can exit cylinder 194 by progressing down ramp 197.

Turning back to FIG. 9, it is noted that in any particular sliding structure, it is possible to selectively provide low friction durable sheeting material 183 to the top surface of slide 180. For example, border 189 can be devoid of such material thus providing a higher friction border about sheeting material 183. Such selective high friction areas can be employed as safety means to slow a user upon approaching an edge of the slide. Additionally, areas of relatively high friction can be dispersed about low friction high durable sheeting material 183 to act as obstacles to be traversed by the skilled enthusiast.

Figure 11:
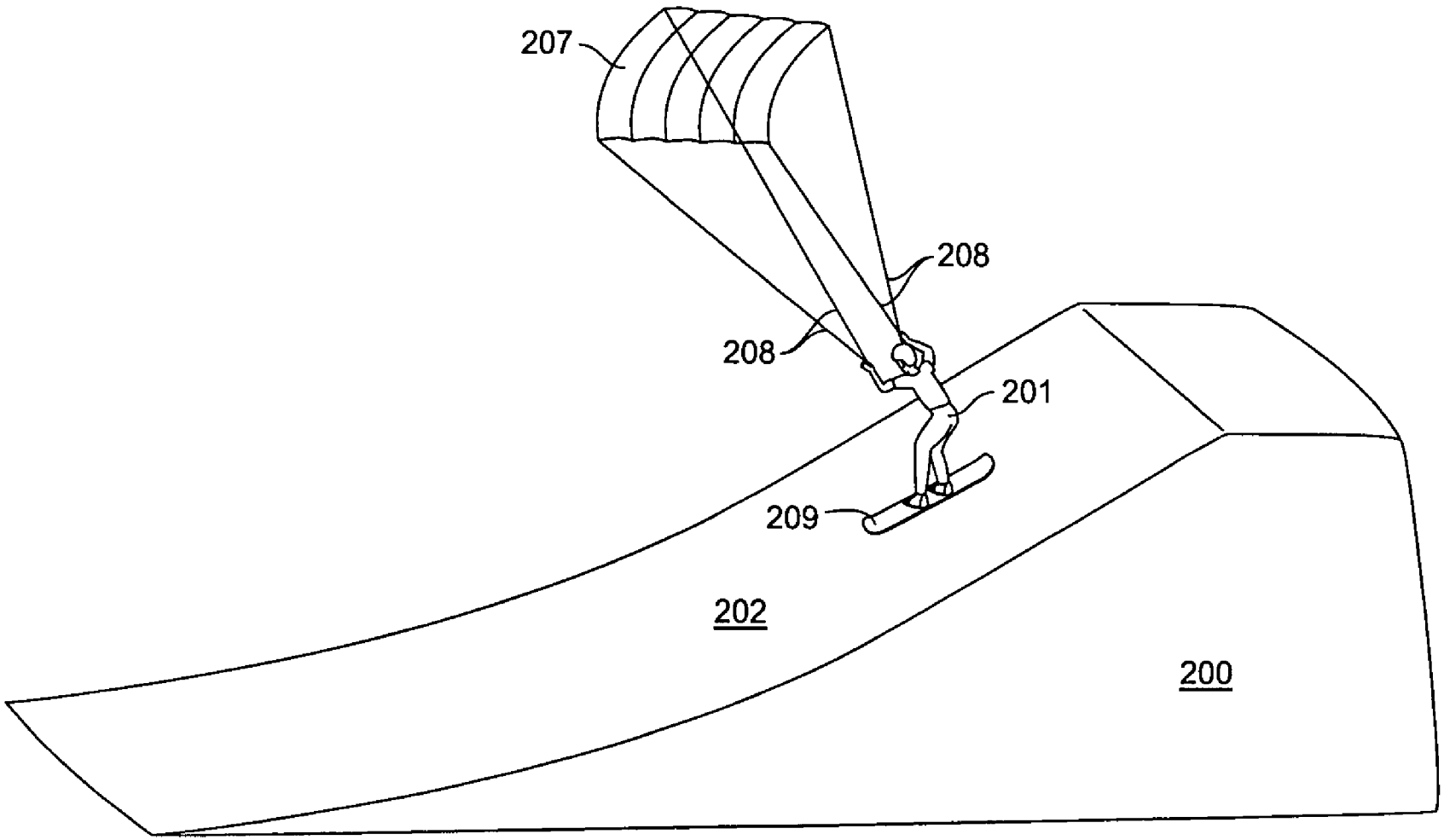
FIG. 11 is a side plan view of a slide and user thereof pursuant to the present invention.

Reference is next made to FIG. 11 which shows user 201 traversing down the top surface 202 of slide 200. In this illustration, user 201 employs a parachute or kite 207 which could act to pull user 201 while grasping lines 208.

Virtually any riding element can be employed by a user while remaining within the spirit and scope of the present invention. For example, in developing sports board skills, a user might wish to employ snow boards, surf boards, boogie boards, skis, skate boards and body boards in employing the exercise apparatus and recreational system of the present invention. Further, dedicated boards consisting of nothing more than a solid core surrounded by selective padding and a bottom surface of a durable low friction sheeting material can be employed as well. As previously noted, stand-alone sheets of such material can be employed to support a user as one traverses along the slide and related elements of the present invention and can even employ patches of such material adhered to selected body portions such as the soles of one's shoes or on the surfaces of knee and elbow pads.

Figure 12A:
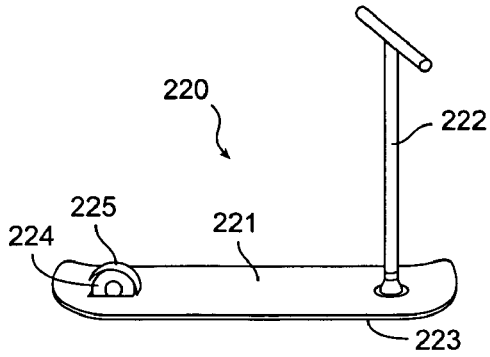
FIGS. 12A, 12B, 12C and 12D are perspective views of three embodiments of "vehicles" used to support a user in practicing the present invention.

In order to further illustrate the breadth of the present invention, reference is made to FIGS. 12A, 12B, 12C and 12D showing just several of the myriad of diverse riding elements contemplated for use herein. For example, FIG. 12A depicts sled 220 having bottom portion 221 for supporting a user and handle portion 222 to enable a user to maintain one's balance and steer sled 220 by shifting the user's body weight. As in previous embodiments, ideally, bottom surface 223 is wholly or partly covered with a low friction durable sheeting material to enhance sliding of sled 220 over the top surface of the slide and related components of the present invention. Sled 22 can also be provided with wheel 224 for control and brake 225 for the same purpose.

Figure 12B:
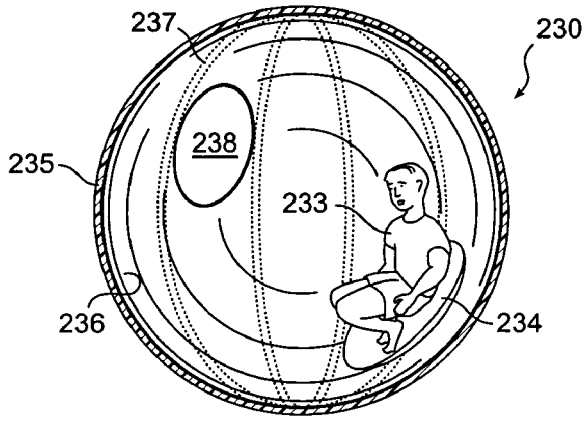

FIG. 12B shows an inflated or foam padded hollow sphere sized to capture user 233 within open area 231. The user can slide along inner surface 232 with or without sports board 234 which can be coated with a durable, low friction layer of material while sphere 230 rolls down the slide and appended components of the present invention. Sphere 230 is provided with inner frame 237 supporting air or foam padded membrane 236 and outer durable shell 235. User 233 can enter and exit sphere 230.

Figure 12C:
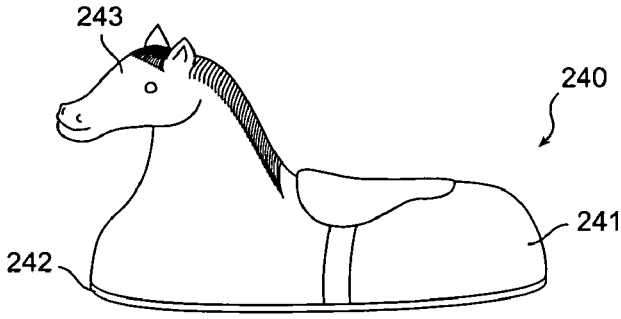
Figure 12D:
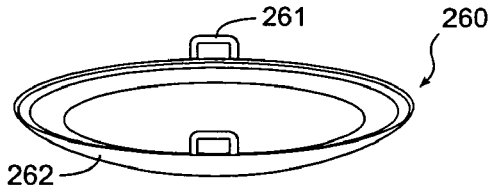

Finally, FIG. 12C shows a modified sports board 240 for use by children. In this instance, board 242 having seating area 241 is intended to support a toddler who might grasp onto a configured animal head portion 243 for sliding on the slide of the present invention.

As noted, the present invention can be employed with sleds of various configurations. As an illustration, reference is made to FIG. 12D wherein saucer sled 260 is provided with handles 261. As in previous embodiments, sled 260 can have a durable, low friction layer applied to bottom surface 262.

Figure 13:
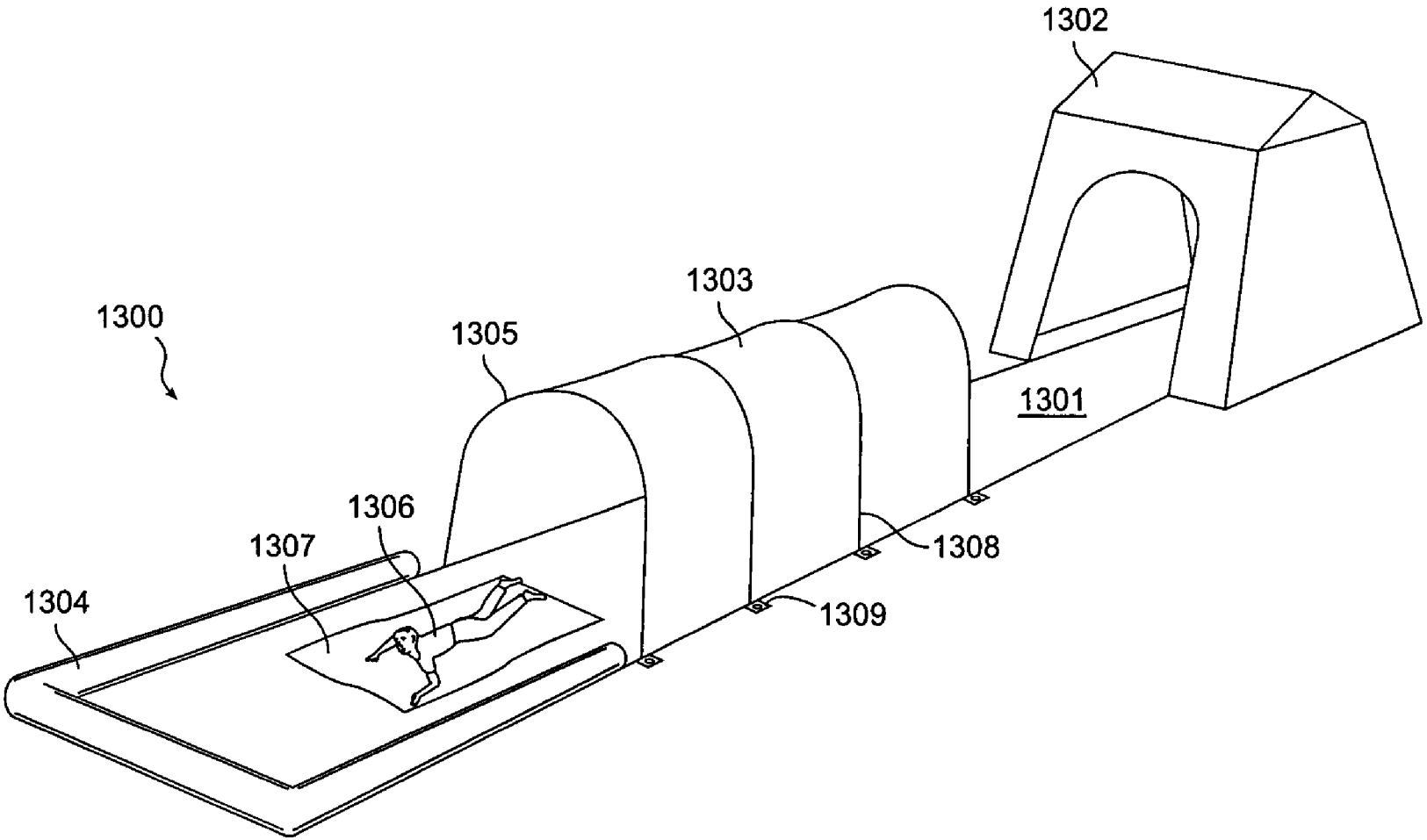
FIG. 13 is a perspective view of the present invention showing the use of a tent structure and tented "pipe" as a further embodiment.

Turning to FIG. 13, slide 1300 includes slide surface 1301 again composed of a low friction, highly durable material which, in this embodiment, is shown terminating by means of inflatable bumpers 1304 thus preventing rider 1306 residing upon membrane 1307 from inadvertently progressing beyond the slide surface. To enhance the recreational nature of the present invention, tent 1302 is erected at the launch point of slide surface 1301 while tent fabric 1303 can be provided in the form of a pipe or tube by means of spaced wire ribs 1308 anchored to the surrounding surface by anchor bolts 1309. In doing so, rider 1306 upon exiting tent structure 1302 would be caused to progress down slide 1301 while experiencing a tunnel-like ride.

Figure 15:
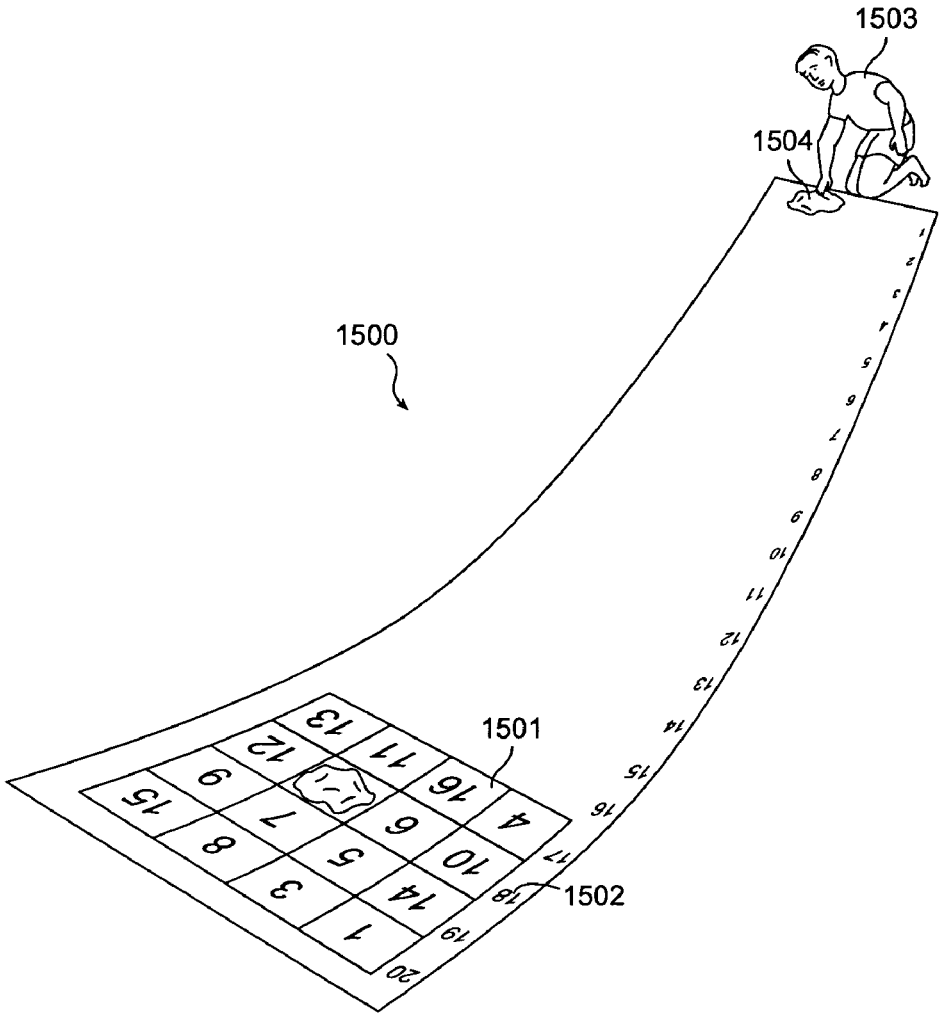
FIG. 15 is a perspective view of the present invention wherein indicia is provided to enhance the recreational use thereof.

As yet a further embodiment, reference is made to FIG. 15 whereby slide 1500 is shown having written indicia 1501/1502 etc. In doing so, slide 1500 is converted into a game whereby rider 1503 can either progress down slide 1500 exercising whatever sliding skills he or she might happen to have to enable rider 1503 to either travel down slide 1500 on membrane 1504 to selectively stop in a predetermined numbered area or alternatively to employ slide 1500 in a shuffleboard-like fashion by propelling membrane 1504 upon slide 1500 for the same purpose.

Figure 16A:
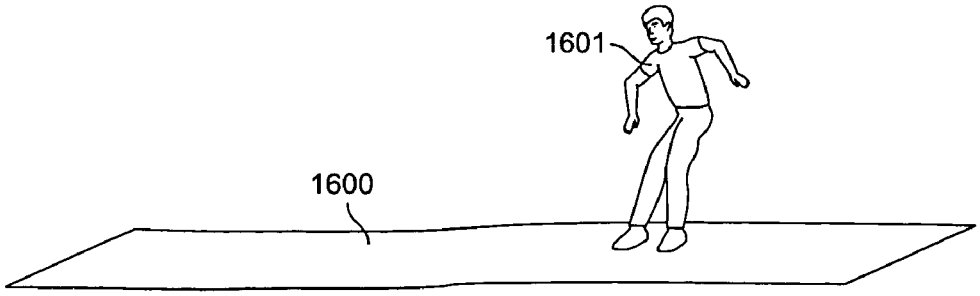
FIGS. 16A and 16B are perspective views of the present invention in its simplest iteration.
Figure 16B:
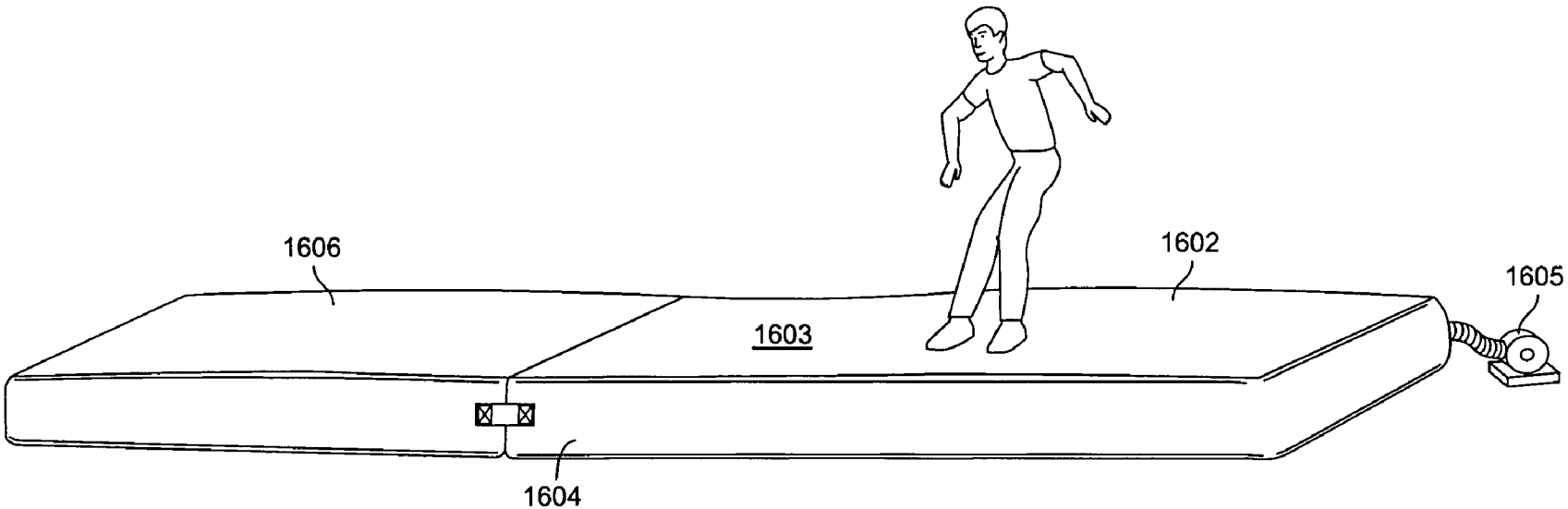

Reference is now made to FIGS. 16A and 16B. In its simplest iteration, the present invention is directed to a sheet or membrane of highly durable low friction material 1600 enabling user 1601 to slide upon sheet 1600 even when sheet 1600 is in a dry state. Up to now, membranes employed for this purpose have only been used with a wet surface in order to create the necessary low friction surface characteristics promoting sliding. Similarly, slide 1602 of FIG. 16B shows that top surface 1603 of a low friction highly durable sheeting material can be supported by substructure 1604 which can be an inflatable membrane whose three-dimensional confirmation is maintained by air blower 1605 or, alternatively, membrane 1604 can be stuffed with a core of foam or rubber for the same purpose. In addition, various sliding elements 1606 can be added end-to-end or side-to-side to slide element 1602 in order to create slides of additional length and/or width. Attachment can be by any well-recognized means such as through the use of Velcro hook and loop connectors, snaps, zippers, ropes, springs, nylon netting and similar expedients.

As previously noted, the present invention can be employed with commercially available sports vehicles which have been modified for use herein. In this regard, reference is made to FIGS. 17 and 18 in order to illustrate this point. Specifically, FIG. 17 discloses the bottom surface ski 1701 including metal runners 1702. Metal runners 1702 are normally sharpened to enable a skier to catch an edge which is quite helpful when traversing icy terrain. However, metal runners 1702 could cause damage to the slides of the present invention. As such, as noted in FIG. 17, metal runners 1702 are removed from the bottom surface of slide 1701 exposing runner indent or slot 1703. At that point, rubber runners 1704 can be installed within slot 1703 to provide the user with a well-defined edge but one which is composed of a material which would not be detrimental to the slide upon which it is used.

Figure 17A:
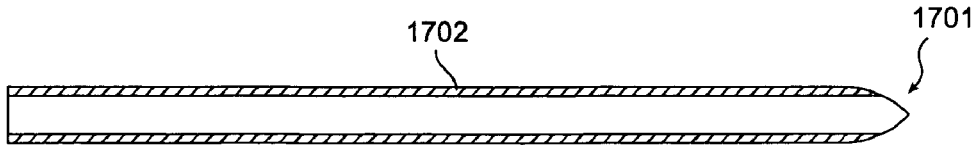
FIG. 17 is a plan view of a series of modifications being made to an existing ski for use in the present invention.
Figure 17B:
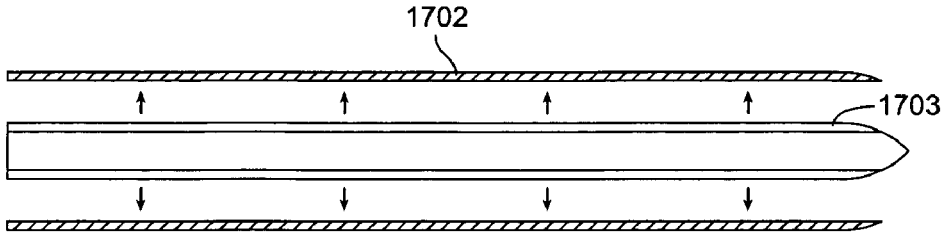
Figure 17C:
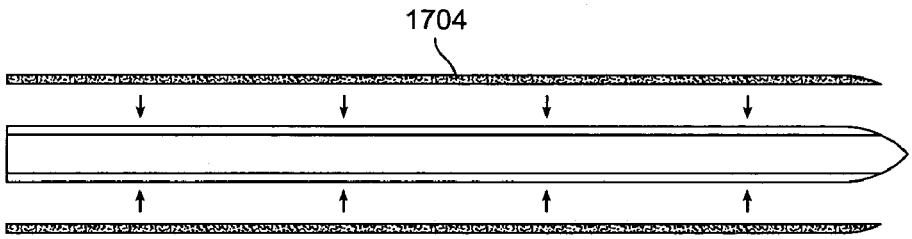
Figure 18A:
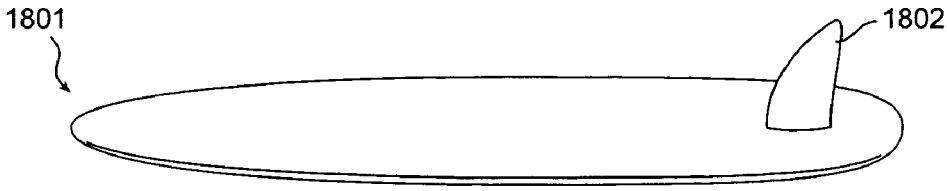
FIG. 18 is a perspective view of a surfboard modified for use in practicing the present invention.
Figure 18B:
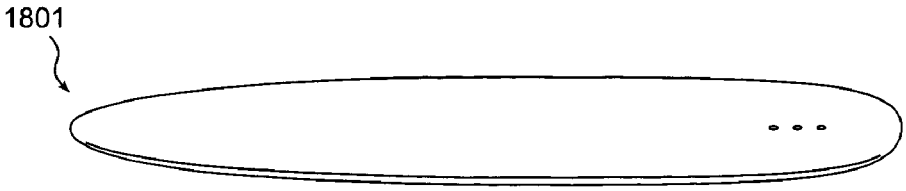

Similarly, reference is made to FIG. 18 showing surf board 1801 which, commercially, is sold with fin 1802 for stability. However, when surf board 1801 is used on a slide of the present invention, it is quite apparent that fin 1802 would severely harm the top surface of the slide. As such, as noted in FIG. 18, fin 1802 is removed when using a commercially available surf board for the present invention. FIGS. 17 and 18 represent two of a wide variety of commercially available sports boards which could be modified for use herein.

Figure 19:
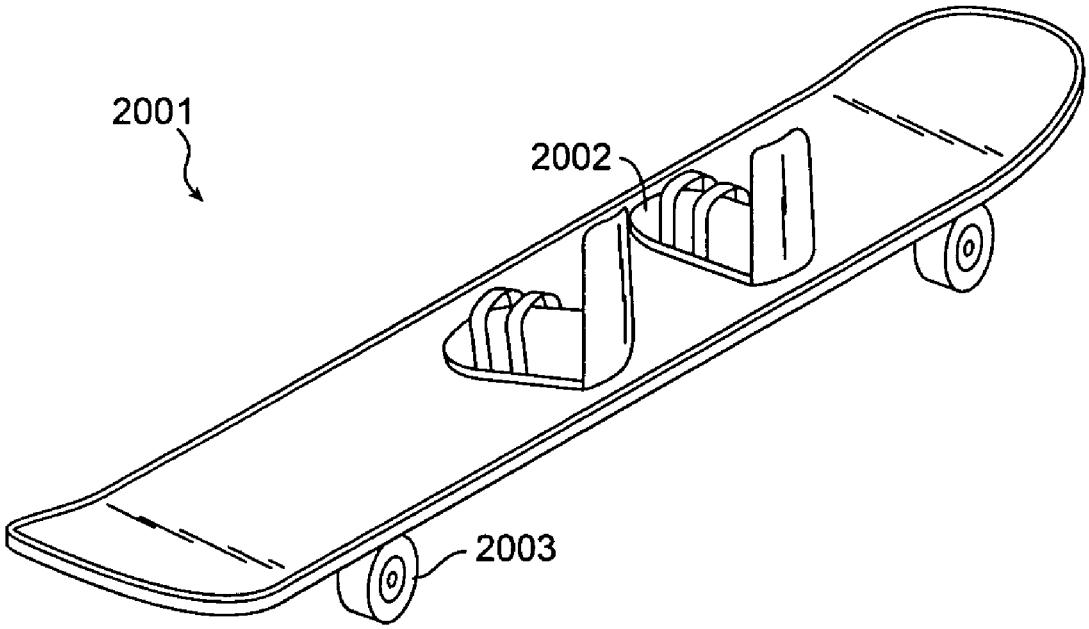
FIG. 19 is a perspective view of a modified snowboard to illustrate the use of dedicated vehicles for use herein.

Similarly, reference is made to FIG. 19 which displays a sports vehicle similar to that shown in FIG. 5. In the iteration shown in FIG. 19, sports board 2001 supporting bindings 2002, from its top surface, looks like a fairly traditional snow board. However, in this instance, removable wheels 2003 can be appended to the bottom surface of the skateboard in a traditional fashion. When done, there is no need for use of a durable low-friction sheeting material to be applied to the bottom of sports board 2001 although, optionally, this could be considered a further embodiment, noting that wheels 2003 can be made removable.

Although practice of the present invention can involve the use of commercially available sports vehicles or commercially available sports vehicles such as sports boards which have been modified for use herein, it is quite apparent that, as an alternative, one could produce a dedicated sports vehicle from the outset.

It should be quite apparent from the above discussion that the present invention contemplates a broad range of configurations. The exercise apparatus and recreational system of this invention which can be both fixed or portable, inflated or padded, and used either wet or dry, alone or with a broad range of appended systems is uniquely adapted to provide one with a platform for skill enhancement and recreational pursuit.

I claim:

1. An inflatable activity slide for supporting a user, the slide comprising:

an inclined inflatable portion with a low-friction top surface for sliding thereon, the inclined inflatable portion having an upper end and a lower end;

a lower substantially horizontal inflatable portion adjacent the lower end of the inclined portion with a low-friction top surface for sliding thereon;

an upper substantially horizontal inflatable portion adjacent the upper end of the inclined portion;

an inflatable side bumper extending along each side of the inclined portion and the upper substantially horizontal portion; and an upwardly extending inflatable support structure for allowing a user to access the upper substantially horizontal portion from a ground surface.

2. The inflatable activity slide of claim 1 further comprising an air blower for maintaining inflation.

3. The inflatable activity slide of claim 1 wherein said slide is portable such that said slide can be deflated for shipping and inflated on-site for use.

4. The inflatable activity slide of claim 1 wherein said low friction top surface includes a separate layer sized to lie upon and substantially fully cover said inclined inflatable portion.

5. The inflatable activity slide of claim 1 wherein said low friction top surface comprises a member selected from the group consisting of nylon, Teflon, sailcloth, Dacron, vinyl, artificial turf, synthetic carpet and polyester resins.

6. The inflatable activity slide of claim 1 wherein means are provided for introducing snow and ice to said top surface.

7. The inflatable activity slide of claim 1, further comprising a fluid conduit for introducing a fluid onto said top surface of said slide.

8. The inflatable activity slide of claim 7, wherein said fluid conduit for introducing a fluid onto said top surface includes a fluid pump.

9. In combination:

the inflatable activity slide of claim 1; and a riding element being of sufficient size to support a user, said riding element configured for riding on said slide.

10. The combination of claim 9, wherein said riding element includes a low friction durable sheeting material for sliding upon said top surface of said slide.

11. The slide of claim 7 wherein said fluid is water.

12. The inflatable activity slide of claim 1, wherein said upper substantially horizontal portion includes a high-friction top surface to prevent inadvertent slippage.

13. The inflatable activity slide of claim 1, wherein said upper substantially horizontal portion includes a bouncy trampoline-like surface.

14. The inflatable activity slide of claim 1, wherein said inflatable support structure includes stairs.

15. The inflatable activity slide of claim 1, wherein said inflatable support structure is integral with at least one of the inclined inflatable portion, the lower substantially horizontal inflatable portion, and the upper substantially horizontal inflatable portion.

16. The inflatable activity slide of claim 1, wherein said side bumper extends along the lower substantially horizontal portion.

17. The inflatable activity slide of claim 1, wherein said side bumper is a first side bumper, the inflatable activity slide further comprising a second side bumper extending along the upper substantially horizontal portion, and positioned above the first side bumper.

18. An inflatable activity slide for supporting a user, the slide comprising:

an inflatable starting pad;

an inflatable stopping pad;

an inflatable sliding portion positioned between said inflatable starting pad and said inflatable stopping pad;

an inflatable side bumper positioned along the length of said inflatable sliding portion;

an upwardly extending support structure for allowing a user to access the starting pad from a ground surface; and wherein the activity slide when inflated has a predetermined configuration in which the starting pad is positioned above and substantially parallel to the stopping pad and the sliding portion is inclined.

19. The inflatable activity slide of claim 18, wherein said support structure is inflatable.

20. The inflatable activity slide of claim 18, wherein said inflatable activity slide is detachable into at least a first section and a second section wherein said first and second sections are adapted to be held together by at least one fastener.

21. The inflatable activity slide of claim 20, wherein said inflatable sliding portion and said inflatable starting pad form the first section, and said inflatable stopping pad forms the second section.

22. The inflatable activity slide of claim 18, further comprising an end bumper positioned along at least a portion of the terminal end of the stopping pad.

23. The inflatable activity slide of claim 22, wherein said inflatable side bumper and said end bumper form a continuous bumper.

24. The inflatable activity slide of claim 18, wherein said inflatable side bumper extends along the starting pad.

25. The inflatable activity slide of claim 18, wherein said starting pad includes a high-friction top surface to prevent inadvertent slippage.

26. The inflatable activity slide of claim 18, wherein said stopping pad includes a high-friction top surface to slow down a user.

27. The inflatable activity slide of claim 18, further comprising a fluid conduit for introducing a fluid onto said slide.

28. The inflatable activity slide of claim 27, wherein said fluid conduit for introducing a fluid onto said top surface includes a fluid pump.

29. The inflatable activity slide of claim 18, further comprising an air blower for maintaining inflation.

30. The inflatable activity slide of claim 18, wherein said slide is portable such that said slide can be deflated for shipping and inflated on-site for use.

31. An inflatable activity slide for supporting a user, the slide comprising:

an inclined inflatable portion with a low-friction top surface for sliding thereon, the inclined inflatable portion having an upper end and a lower end;

a lower substantially horizontal inflatable portion with a low-friction top surface for sliding thereon;

an upper substantially horizontal inflatable portion adjacent the upper end of the inclined portion;

an inflatable side bumper extending along each side of the inclined portion and the upper substantially horizontal portion;

a support structure for allowing a user to access the upper substantially horizontal portion from a ground surface; and wherein said inflatable activity slide is detachable into at least a first section and a second section wherein said first and second sections are adapted to be held together by at least one fastener.

32. The inflatable activity slide of claim 31, wherein said inclined inflatable portion and said upper substantially horizontal portion form the first section, and said lower substantially horizontal portion forms the second section.

33. The inflatable activity slide of claim 31, wherein said support structure is inflatable.

34. The inflatable activity slide of claim 33, wherein said support structure is integral with at least one of the inclined inflatable portion, the lower substantially horizontal inflatable portion, and the upper substantially horizontal inflatable portion.

35. The inflatable activity slide of claim 31, wherein said lower substantially horizontal inflatable portion is adjacent the lower end of said inclined portion.

36. An inflatable activity slide for supporting a user, the slide comprising:

an inclined inflatable portion with a low-friction top surface for sliding thereon, the inclined inflatable portion having an upper end and a lower end;

a lower substantially horizontal inflatable portion with a low-friction top surface for sliding thereon;

an upper substantially horizontal inflatable portion adjacent the upper end of the inclined portion;

an inflatable side bumper extending along each side of the inclined portion and the upper substantially horizontal portion;

an upwardly extending inflatable support structure for allowing a user to access the upper substantially horizontal portion from a ground surface;

wherein said inclined inflatable portion and said upper substantially horizontal portion form a first section, and said lower substantially horizontal portion forms a second section, wherein the first and second sections are detachable and are adapted to be held together by at least one fastener.

37. The inflatable activity slide of claim 36, wherein said first section includes a portion of the side bumper, and said second section includes another portion of the side bumper.

38. The inflatable activity slide of claim 36, wherein said lower substantially horizontal inflatable portion is adjacent the lower end of said inclined portion.

* * * * *